US006254498B1

(12) United States Patent
Tyner

(10) Patent No.: US 6,254,498 B1
(45) Date of Patent: Jul. 3, 2001

(54) INSTRUCTIONAL DEVICE WITH ADJUSTABLE BALL-STRIKING SLEEVE

(76) Inventor: Matthew A. Tyner, 6618 N. Cricklewood Rd., Indianapolis, IN (US) 46220

( * ) Notice: Subject to any disclaimer, the term of this patent is extended or adjusted under 35 U.S.C. 154(b) by 0 days.

(21) Appl. No.: 08/967,064

(22) Filed: Nov. 10, 1997

Related U.S. Application Data

(60) Provisional application No. 60/033,313, filed on Dec. 11, 1996.

(51) Int. Cl.[7] ..... A63B 37/00
(52) U.S. Cl. ..... 473/437; 473/422
(58) Field of Search ..... 473/437, 322, 473/457, 564, 568, 233, 520, 537, 422

(56) References Cited

U.S. PATENT DOCUMENTS

| | | | | |
|---|---|---|---|---|
| 2,135,648 | * | 11/1938 | Stompf | 473/233 |
| 2,470,816 | * | 5/1949 | Harvey | 473/233 |
| 3,136,546 | | 6/1964 | Connolly . | |
| 3,414,260 | | 12/1968 | Gust . | |
| 3,433,418 | * | 3/1969 | Tanguay | 473/568 |
| 3,521,883 | | 7/1970 | Hamilton . | |
| 3,623,724 | * | 11/1971 | Lande | 473/437 |
| 3,897,068 | * | 7/1975 | Stables | 473/233 |
| 4,260,150 | * | 4/1981 | Tabet | 473/437 |
| 4,373,718 | | 2/1983 | Schmidt . | |
| 4,423,868 | * | 1/1984 | Younts | 473/564 |
| 5,011,145 | * | 4/1991 | Bartkowicz | 473/568 |
| 5,014,984 | | 5/1991 | Brockhoff . | |
| 5,024,436 | * | 6/1991 | Vento | 473/437 |
| 5,050,877 | * | 9/1991 | Wales | 473/437 |
| 5,100,136 | * | 3/1992 | Chen | 473/520 |
| 5,360,209 | | 11/1994 | Mollica . | |
| 5,395,107 | * | 3/1995 | Pippo | 473/437 |
| 5,456,461 | | 10/1995 | Sullivan . | |
| 5,711,728 | * | 1/1998 | Marcelo | 473/520 |

* cited by examiner

*Primary Examiner*—Sam Rimell
(74) *Attorney, Agent, or Firm*—Adams, Schwartz & Evans, P.A.

(57) ABSTRACT

An instructional device for training a user to hit a ball. The device includes an elongate handle portion for being gripped by the user, and an elongate body portion extending from the handle portion. An enlarged diameter ball-striking sleeve is carried by the body portion and defines a hitting zone within which the user attempts to make contact with the ball. A sleeve-adjusting surface is formed with the ball-striking sleeve for moving the sleeve along the length of the body portion between a plurality of hitting positions. Friction holds the ball-striking sleeve in a selected one of the hitting positions as the instructional device is swung by the user.

7 Claims, 2 Drawing Sheets

INSTRUCTIONAL DEVICE WITH ADJUSTABLE BALL-STRIKING SLEEVE

This application claims the benefit of U.S. Provisional No. 60/033,313 filed Dec. 11, 1996.

TECHNICAL FIELD AND BACKGROUND OF THE INVENTION

This invention relates to an instructional device having an adjustable ball-striking sleeve for training a batter to consistently make contact with a pitched ball in an area representing the sweet spot of a standard baseball or softball bat, and for improving the hand-eye coordination of the batter. The invention has further application as an instructional device for other sports, such as tennis, racquetball, squash, and cricket.

Numerous attempts have been made in the past to provide an instructional device which helps improve the ability of a batter to effectively hit a baseball or softball with a bat. The device disclosed in U.S. Pat. No. 5,014,984 to Brockhoff is primarily intended to teach proper rotation of the batter's wrists during a swing. This device further includes a batting portion having a width corresponding generally to that of a standard baseball bat, and a body portion intermediate the handle and batting portion. The body portion is of reduced diameter to reduce the likelihood of contacting the ball in this area of the device. The batting portion is intended to represent the sweet spot of the bat. The batting portion, however, is not adjustable along the length of the device and would not accurately represent the sweet spot for every bat. Moreover, because the batting portion cannot be adjusted, the ability to effectively exercise the batter's hand-eye coordination is reduced.

The present invention addresses these and other problems of such devices by providing an instructional device with an adjustable ball-striking sleeve which can be located to represent the sweet spot of any size bat, and which is easily moved along the body portion of the device to different fixed positions to better exercise the batter's hand-eye coordination. The outside diameter of the ball-striking sleeve is greater than the diameter of the body portion, and is formed of a relatively soft compressible material. The body portion is formed of a hard rigid material such that a ball struck with this part of the device will make a clearly distinct sound indicating improper ball contact. The ball used with the invention is preferably a lightweight plastic "whiffle" ball.

SUMMARY OF THE INVENTION

Therefore, it is an object of the invention to provide an instructional device having an adjustable ball-striking sleeve which is easily moved along the length of the device to different hitting positions.

It is another object of the invention to provide an instructional device which improves the batter's ability to hit a baseball or softball.

It is another object of the invention to provide an instructional device which improves the batter's ability to bunt a baseball.

It is another object of the invention to provide an instructional device wherein the ball-striking sleeve can be positioned to represent the sweet spot for standard bats of all lengths.

It is another object of the invention to provide an instructional device which uses the effect of friction to hold the ball-striking sleeve in a fixed position during a batter's swing.

It is another object of the invention to provide an instructional device which can be used to exercise the batter's hand-eye coordination.

It is another object of the invention to provide an instructional device which exercises the batter's "quick twitch" muscles located in the hands, wrists, and forearms to improve the bat speed of the batter.

It is another object of the invention to provide an instructional device which is relatively light-weight such that the batter can practice increased consecutive swing repetitions to develop muscle memory without developing substantial muscle fatigue.

It is another object of the invention to provide an instructional device which generates an audible indication of bat speed when swung.

It is another object of the invention to provide an instructional device which creates a "swoosh" sound when swung.

It is another object of the invention to provide an instructional device which helps prevent lunging, overswinging, and uppercutting.

It is another object of the invention to provide an instructional device which helps develop top hand/bottom hand control of the batter.

It is another object of the invention to provide an instructional device which helps the batter identify the ideal contact zone.

It is another object of the invention to provide an instructional device which helps the batter develop a proper swing plane.

It is another object of the invention to provide an instructional device helps the batter improve his timing.

It is another object of the invention to provide an instructional device which builds confidence.

These and other objects of the present invention are achieved in the preferred embodiments disclosed below by providing an instructional device for training a user to hit a ball. The device includes an elongate handle portion for being gripped by the user, and an elongate body portion extending from the handle portion. An enlarged diameter ball-striking sleeve is carried by the body portion and defines a hitting zone in which the user attempts to make contact with the ball. Adjusting means are provided for moving the ball-striking sleeve along the length of the body portion between a plurality of hitting positions. Retaining means holds the ball-striking sleeve in a selected one of the hitting positions as the instructional device is swung by the user.

According to another preferred embodiment of the invention, the adjusting means includes a raised, sleeve-adjusting flange integrally formed with the ball-striking sleeve, and adapted for being gripped by the user to move the ball-striking sleeve from one hitting position to another.

According to another preferred embodiment of the invention, the adjusting means includes first and second raised sleeve-adjusting flanges integrally formed at opposite ends of the ball-striking sleeve.

According to yet another preferred embodiment of the invention, the body portion and ball-striking sleeve are formed of different materials adapted for generating distinct sounds upon contacting the ball.

According to yet another preferred embodiment of the invention, the body portion is formed of fiberglass.

According to yet another preferred embodiment of the invention, the ball-striking sleeve is formed of a resilient, foam rubber material.

According to yet another preferred embodiment of the invention, the handle portion and the body portion are integrally formed together.

According to yet another preferred embodiment of the invention, a synthetic leather strip is wrapped around the handle portion to enhance the grip of the user.

According to yet another preferred embodiment of the invention, markings are applied to the body portion for indicating the proper location of the ball-striking sleeve for each of the plurality of hitting positions.

According to another embodiment, the instructional device includes an elongate handle portion for being gripped by the user, and an elongate body portion extending from the handle portion. A resilient, enlarged diameter ball-striking sleeve is carried by the body portion and defines a hitting zone within which the user attempts to make contact with the ball. The ball-striking sleeve has an inner diameter slightly less than an outer diameter of the body portion, such that the ball-striking sleeve is frictionally held in a selected one of a plurality of fixed hitting positions as the device is swung. At least one raised, sleeve-adjusting surface is formed with the ball-striking sleeve for being gripped by the user to move the ball-striking sleeve along the length of the body portion between the plurality of fixed hitting positions.

According to another preferred embodiment of the invention, the sleeve-adjusting surface includes first and second raised flanges integrally formed at opposite ends of the ball-striking sleeve.

According to another embodiment of the invention, a method of training a batter to hit a ball includes the steps of providing an instructional device having an elongate handle portion, an elongate body portion extending from the handle portion, and a ball-striking sleeve carried by the body portion. The batter swings the instructional device at the ball in an effort to hit the ball with the ball-striking sleeve. The location of the ball-striking sleeve on the length of the body portion is then adjusted and the previous step repeated.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF THE PREFERRED EMBODIMENT AND BEST MODE

Figures 1, 2:
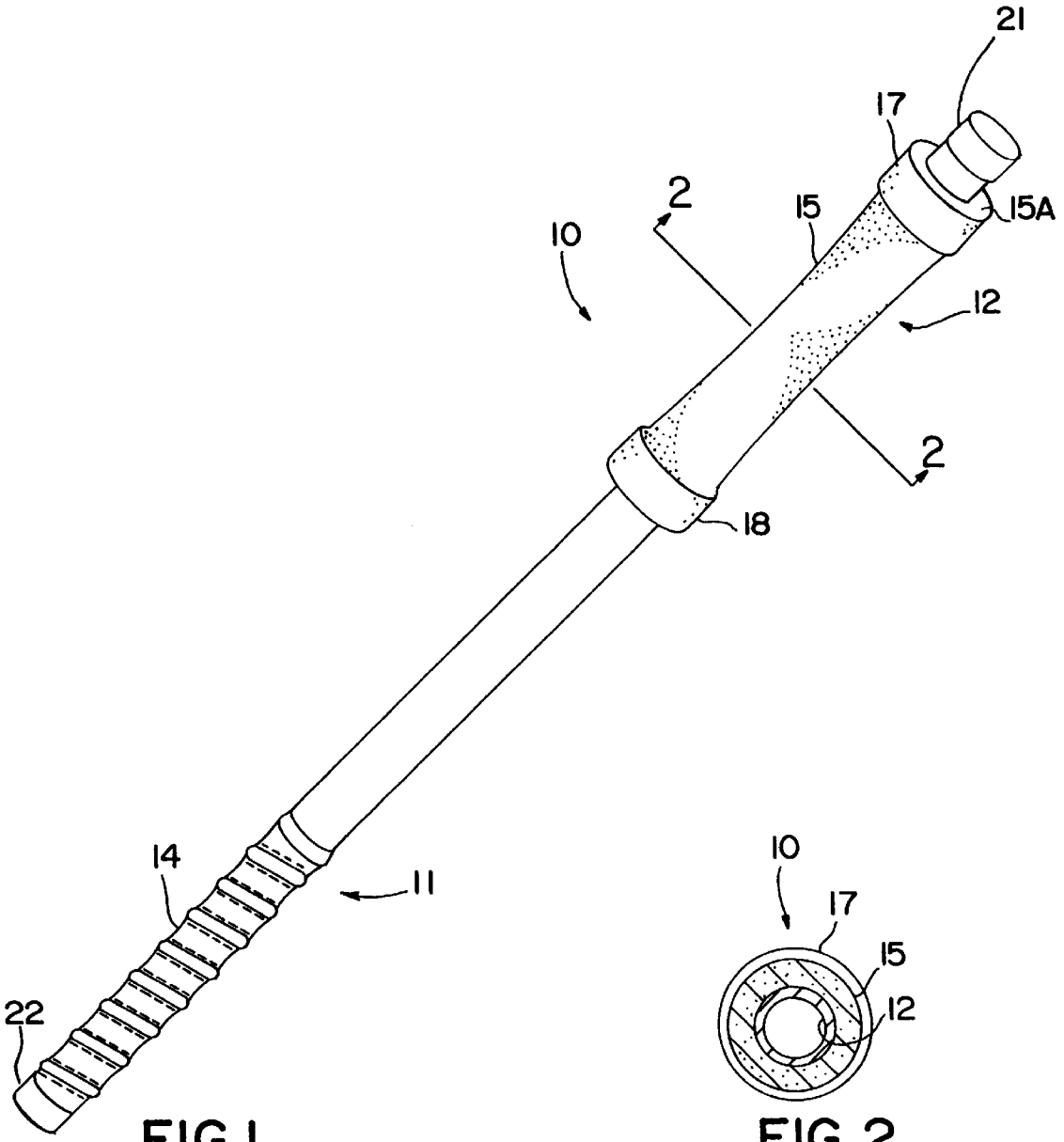
FIG. 1 is a perspective view of an instructional device with an adjustable ball-striking sleeve according to one preferred embodiment of the invention.
FIG. 2 is a cross-sectional view taken substantially along lines 2—2 of FIG. 1.
Figure 3:
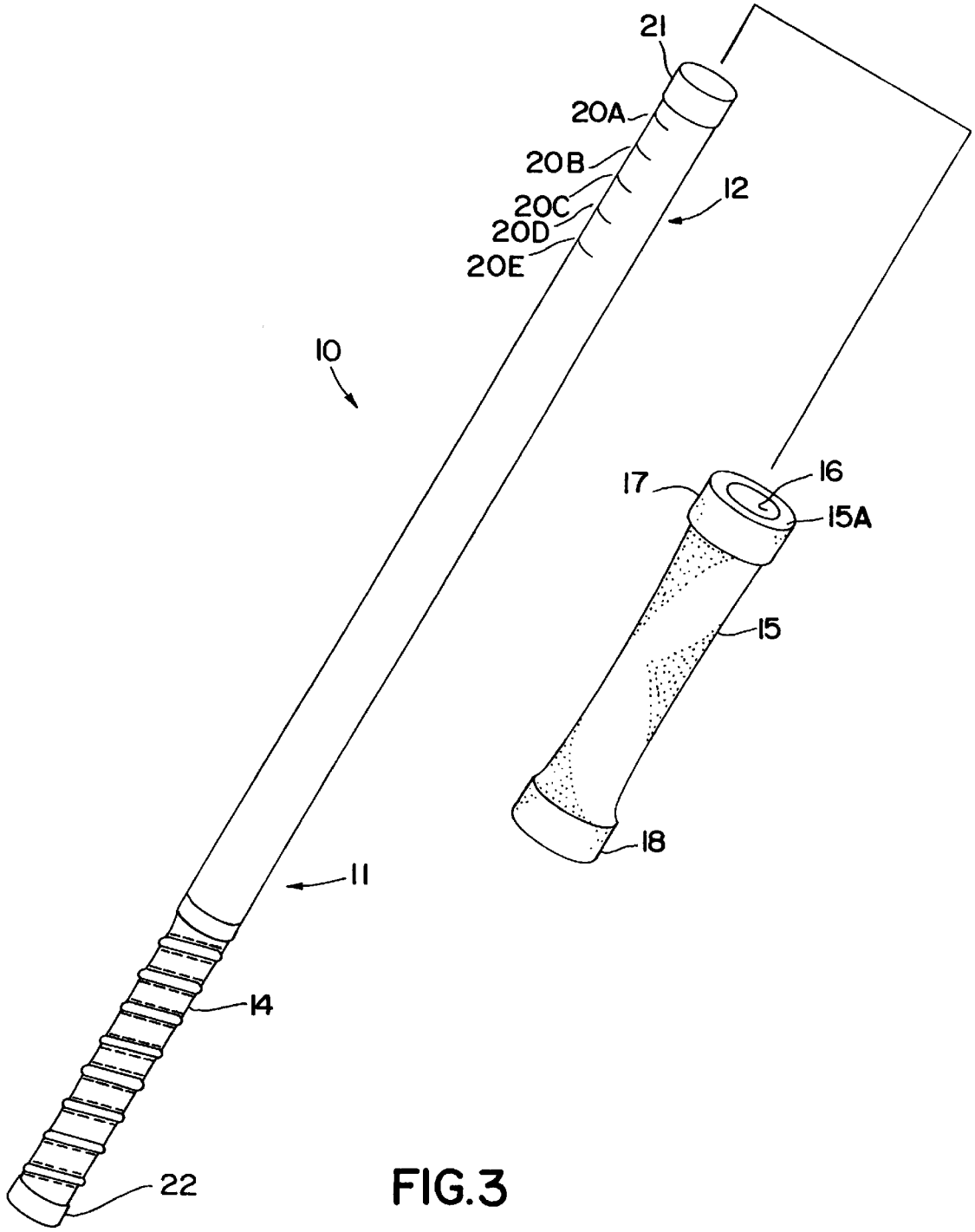
FIG. 3 is a perspective view of the device with the ball-striking sleeve removed to show the markings used for properly locating the sleeve on the device.

Referring now specifically to the drawings, an instructional device with an adjustable ball-striking sleeve according to the present invention is illustrated in FIG. 1 and shown generally at reference numeral 10. The device 10 is applicable for training a batter to consistently make contact with a pitched ball in an area representing the sweet spot of a standard baseball or softball bat, and for improving the hand-eye coordination of the batter. The term "sweet spot" is defined herein as the optimal hitting area around the center of mass of the bat. For a standard 33-inch bat, for example, the sweet spot is generally defined by an 8-inch length extending from about 3 inches from the barrel end of the bat towards the handle.

As shown in FIGS. 1 and 2, the device 10 includes an integrally formed handle portion 11 and body portion 12 preferably formed of lightweight, utility-strength continuous spun-fiberglass interwoven with a structured, non-moisture honeycomb core. The fiberglass provides flexibility and strength sufficient to withstand 2500 psi. Alternatively, plastic PVC tubing or wood may be used. A flexible, elongate synthetic leather strip 14 is wrapped around and adhered to the handle portion 12 of the device 10 to provide a soft, comfortable grip. According to another embodiment, the handle includes a wrapped, cork strip such as disclosed in U.S. Pat. No. 4,373,718. The complete disclosure of the '718 Patent is incorporated herein by reference.

A tubular, ball-sting sleeve 15 is positioned on the device 10 by placing it on the end of the body portion 12, and sliding it to the proper position. The sleeve 15 is held in the desired fixed position by friction as the device 10 is swung. Preferably, the sleeve 15 is formed of a compressible, closed-cell, extruded, tubular foam rubber material, such as EPDM, neoprene, nitrile, or acrylonitrile/PVC blend, and is uniform and homogeneous throughout its entire structure. The resilient exterior of the sleeve 15 produces a "trampoline effect" upon striking the ball, while absorbing shock without discomfort to the batter. The diameter of the longitudinal center opening 16 through the sleeve 15 is slightly smaller than the diameter of the body portion 12 of the device 10 and expands as the sleeve 15 is slid onto the body portion 12 to frictionally hold the sleeve 15 on the device 10. According to an alternative embodiment (not shown), small screws or other fasteners are passed through the sleeve and into the device to retain the sleeve in a fixed position while the device is swung.

Raised, sleeve-adjusting annular flanges 17 and 18 are formed on opposite ends of the sleeve 15 for being gripped by the batter to adjust of the location of the sleeve 15 on the body portion 12. The center portion of the sleeve 15 between the flanges 17 and 18 is preferably slightly tapered to further isolate the targeted hitting zone.

Markings 20A–20E representing different hitting positions are provided along the length of the body portion 12 to indicate the proper location of the ball-striking sleeve 15 for a given size bat. For example, by moving the end 15A of the ball-striking sleeve 15 into alignment with the first marking 20A located about 1 inch from the end of the body portion 12, the batter can practice making proper ball-contact with a hitting zone representing the sweet spot of a standard 33" bat. With the ball-striking sleeve 15 located at the marking 20E about 5 inches from the end of the body portion 12, the batter can practice making proper ball-contact with a hitting zone representing the sweet spot of a standard 28" bat. Markings 20B–20D represent locations of the sleeve 15 for other standard bats of different lengths.

According to one technique of using the instructional device 10, the sleeve 15 is moved to a desired position on the body portion 12 corresponding to the area of the sweet spot for a given size baseball or softball bat. Whiffle balls or other small plastic balls or tennis balls are then pitched to the batter who attempts to hit the ball directly on sleeve 15, or sweet spot. A "mis-hit" occurs when the ball is struck with the handle 11 or body portion 12 of the device 10. Because of the different material construction of the sleeve 15 and handle and body portions 11 and 12, the "hits" make a distinctively different sound from the "mis-hits" thereby indicating the proficiency and improvement of the batter.

The instructional device 10 focuses on improving the batter's hand-eye coordination. By varying the position of the sleeve 15 on the device 10, the batter learns to "see" the ball and to properly adjust the swing in order to strike the ball on the sleeve 15. The instructional device 10 can also be used in a similar manner to improve the bunting skills of the batter.

Other drills using the instructional device 10 of the present invention include:

(i) Simple Dry Swings: The batter takes "dry" swings paying close attention to the details of proper swing mechanics while emphasizing bat speed. This exercise builds muscle memory without creating muscle fatigue, and stimulates the quick-twitch muscles used to improve bat speed.

(ii) Side Toss: An instructor positioned a short distance to the side of the batter tosses the ball to the batter who attempts to hit the ball while concentrating on the specific point of contact in the hitting zone. This exercise focuses on improving hand-eye coordination and bat speed.

(iii) Side Bounce: An instructor positioned a short distance to the side of the batter bounces the ball to the batter who attempts to hit the ball while tracking the ball to contact. This exercise further improves hand-eye coordination.

(iv) Short Toss: An instructor positioned a short distance (about 15–20 feet) in front of the batter throws the ball into the strike zone. The batter attempts to hit the ball in the proper hitting zone of the device 10. This exercise builds confidence, emphasizes proper swing plane, and improves hand-eye coordination.

(v) Top Hand/Bottom Hand Short Toss: An instructor positioned a short distance in front of the batter throws the ball into the strike zone. The batter attempts to hit the ball in the proper hitting zone while swing the device 10 with only one hand. The batter alternates using the top hand and the bottom hand. This exercise emphasizes proper swing plane and swing mechanics.

(vi) Three-Position Short Toss: From a short distance, the instructor moves in an arc in front of the batter between a position directly in front of the batter, a position in-line with a point between second base and third base, and a position in-line with a point between second base and first base. The batter practices tracking the ball from different angles, and then hitting the ball back towards the area it was pitched. This exercise teaches the batter to hit the ball hard to all fields, helps develop proper swing plane, and improves hand-eye coordination.

When swinging the instructional device 10, the speed of the ball-striking sleeve 15 though the air creates a "swoosh" sound. For right-hand batters, this sound should be distinctly heard in the right ear. This indicates that maximum bat speed has been generated from the beginning of the swing to the point of ball contact. Detecting the "swoosh" sound in the left ear indicates an improper swing, as maximum bat speed is then generated from the point of contact to the end of the swing or follow-though.

According to one preferred embodiment, the total length of the device 10 is about 33 inches—the handle portion 11 being about 11 inches and the body portion 12 being about 22 inches. The length of the ball-striking sleeve 15 is preferably about 8 inches. The circumference of the body portion 12 is about 2.75 inches, while the circumference of the ball-striking sleeve 15 between the raised flanges 17 and 18 is about 4.25 inches. The circumference of the raised flanges 17 and 18 is about 5 inches. The length of each raised flange 17 and 18 is about 0.5 inches. In addition, plastic caps 21 and 22 are preferably located on opposite ends of the device 10.

An instructional device is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. An instructional device for training a user to hit a ball, comprising:

(a) an elongate handle portion for being gripped by a user;

(b) an elongate body portion extending from said handle portion;

(c) an enlarged diameter ball-striking sleeve formed of a resilient foam rubber material and carried by said body portion, said sleeve having a generally cylindrical exterior surface with an outer diameter larger than an outer diameter of said body portion, and defining a hitting zone within which a user attempts to make contact with the ball;

(d) first and second raised sleeve-adjusting flanges immovably formed at opposite ends of said ball-striking sleeve for being gripped by a user to move said ball-striking sleeve along the length of said body portion between a plurality of hitting positions; and (e) retaining means for holding said ball-striking sleeve in a selected one of the hitting positions as the instructional device is swung by a user.

2. An instructional device according to claim 1, wherein said body portion and said ball-striking sleeve are formed of different materials adapted for generating distinct sounds upon contacting the ball.

3. An instructional device according to claim 1, wherein said body portion is formed of fiberglass.

4. An instructional device according to claim 1, wherein said handle portion and said body portion are integrally formed together.

5. An instructional device according to claim 1, and comprising a leather strip wrapped around said handle portion to enhance the grip of the user.

6. An instructional device according to claim 1, and comprising markings applied to said body portion for indicating the proper location of said ball-striking sleeve for each of the plurality of hitting positions.

7. An instructional device for training a user to hit a ball, comprising:

(a) an elongate handle portion for being gripped by a user;

(b) an elongate body portion extending from said handle portion;

(c) a resilient, enlarged diameter ball-striking sleeve formed of a resilient foam rubber material and carried by said body portion, said sleeve having a generally cylindrical exterior with an outer diameter larger than an outer diameter of said body portion, and defining a hitting zone within which a user attempts to make contact with the ball, said ball-striking sleeve having an inner diameter slightly less than the outer diameter of said body portion, such that said ball-striking sleeve is frictionally held in a selected one of a plurality of fixed hitting positions as the device is swung; and (d) first and second sleeve-adjusting flanges immovably formed at opposite ends of said ball-striking sleeve for being gripped by a user to move said ball-striking sleeve along the length of said body portion between the plurality of fixed hitting positions.

* * * * *